United States Patent [19]

Gamell

[11] 4,307,574

[45] Dec. 29, 1981

[54] AIR COMPRESSING SYSTEM AND PROCESS

[75] Inventor: Joseph A. Gamell, Kalamazoo, Mich.

[73] Assignee: Joseph Gamell Industries, Inc., Kalamazoo, Mich.

[21] Appl. No.: 32,769

[22] Filed: Apr. 24, 1979

[51] Int. Cl.[3] ..... F01K 13/00

[52] U.S. Cl. ..... 60/676; 60/655; 62/470

[58] Field of Search ..... 60/645, 651, 655, 670, 60/671; 62/238 C, 238 R, 470

[56] References Cited

U.S. PATENT DOCUMENTS

| | | | |
|---|---|---|---|
| 979,579 | 12/1910 | Shuman | 60/651 |
| 2,952,138 | 9/1960 | Russell et al. | 60/671 |
| 3,856,493 | 12/1974 | Bulkley | 62/470 X |
| 4,182,127 | 1/1980 | Johnson | 60/618 |

*Primary Examiner*—Allen M. Ostrager
*Assistant Examiner*—Stephen F. Husar
*Attorney, Agent, or Firm*—Gordon W. Hueschen

[57] ABSTRACT

The invention relates to an air compressing system in which ambient air is drawn through a turbine driven flow-thru compressor into the intake of a primary compressor, and the hot effluent from the primary compressor is utilized to provide superheated vapor to drive the turbine.

4 Claims, 1 Drawing Figure

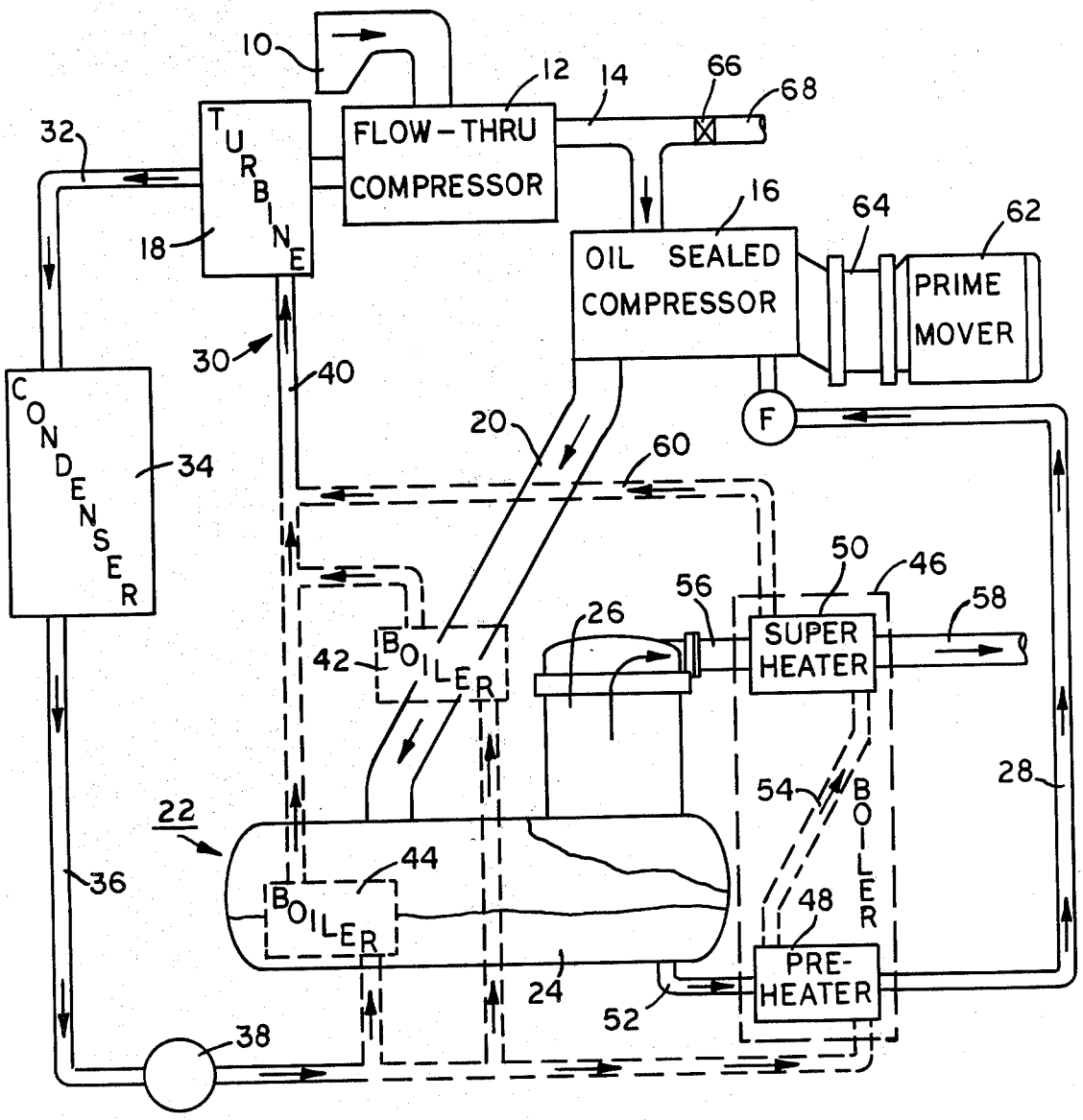
10
12
14
66
68
32
TURBINE
FLOW-THRU COMPRESSOR
16
64
62
18
OIL SEALED COMPRESSOR
PRIME MOVER
30
40
CONDENSER
34
20
60
F
50
46
56
58
26
SUPER HEATER
42
BOILER
54
BOILER
28
22
44
36
BOILER
48
PRE-HEATER
24
52
38

AIR COMPRESSING SYSTEM AND PROCESS

BACKGROUND OF THE INVENTION

Field of Invention and Prior Art

The invention relates to air compressing systems and is particularly directed to improvements in air compressing systems in which a sealant liquid is circulated through the compressor separated from the compressed air effluent, cooled, and recycled to the compressor.

It is well known that the compression of air is an exothermic process and that especially in large compressors the amount of heat generated is sufficient to cause a very substantial problem in regard to its dissipation. This problem is particularly great in air compressors of the oil-sealed type, that is, compressors in which a sealant fluid is recycled through the compressor to effect a seal between the compressor screws or gears and the air. In such compressors, the sealant liquid must be separated from the compressed air, cooled and recycled to the compressor. It is also common to interpose a heat exchanger in the compressed air effluent line to cool it before it is delivered for use.

Objects of the Invention

It is an object of the invention to provide a new and improved air compressing system and process. It is a further object of the invention to provide means for effectively cooling the compressed air effluent. It is a further object of the invention to provide means for utilizing the heat of compression in the air compressing system and process. It is a further object of the invention to provide improvements in liquid-sealed compressing systems. It is a further object of the invention to provide a system for recovering the heat of compression in the sealant liquid and for utilizing it in the air compressing system. It is a further object of the invention to provide such an air compressing system with means for recovering the heat of compression from the sealant liquid and the compressed air effluent and utilizing it in the system. Further objects of the invention are to avoid the disadvantages of the prior art and to obtain such advantages as will appear as the description proceeds.

BRIEF DESCRIPTION OF THE INVENTION

The invention relates to an air compressing system which comprises a primary compressor, a prime mover for driving the primary compressor, a high speed flow-thru compressor, a turbine for driving the high speed flow-thru compressor, means for channeling the output of the flow-thru compressor into the intake of the primary compressor, heat exchange means for extracting heat of compression from the effluent of the primary compressor, and a closed liquid-vapor cycle including a condensor, a boiler, and the turbine, the boiler being thermally connected with the heat exchange means whereby the heat of compression is transferred to the liquid-vapor medium in the cycle, and the mass of the liquid, the boiling point thereof, and the latent heat of vaporization thereof being such that the heat of compression will convert the liquid into superheated vapor in a quantity and at a pressure sufficient to drive the turbine.

By a flow-thru compressor is meant a compressor of a fan or an impeller type or any type in which air can be drawn freely through the compressor even when it is not operating. Thus, the input to the primary compressor is obtained by drawing air through the flow-thru compressor at all times, whether it is operating or not.

The invention more particularly relates to an air compressing system in which the primary compressor is one in which a sealant liquid is cycled through the compressor, cooled, separated from the compressed air effluent, either before or after the cooling, and returned to the primary compressor, and in which the cooling of the sealant liquid is effected at least in part by heat exchange with condensed liquid in the liquid vapor cycle. Advantageously, the hot sealant liquid is passed in heat exchange with the condensed liquid to impart at least a portion of the heat content of the hot sealant liquid to the condensed liquid of the liquid vapor cycle. It is also of advantage to pass the hot gas effluent of the compressor in heat exchange with the liquid vapor medium in the liquid vapor cycle in order to generate a superheated vapor for driving the turbine. Advantageously, the liquid-vapor medium is first passed in heat exchange with the hot sealant liquid to effect preheating thereof and then into heat exchange with the hot compressed gas to effect a desired superheating.

The invention also relates to a process of producing compressed air in which the air to be compressed in a primary compressor is drawn through a high-speed flow-thru compressor driven by a turbine, and in which the heat of compression is utilized to generate superheated vapor for driving the turbine.

BRIEF DESCRIPTION OF THE DRAWINGS

FIG. 1 is a schematic drawing of the apparatus and process of the invention.

DETAILED DESCRIPTION OF THE INVENTION

In the Drawing ambient air is drawn through intake 10 into a flow-thru compressor 12 then through line 14 into a primary compressor 16. The primary compressor 16 advantageously is of the so-called oil-sealed type in which a sealant liquid is cycled through the compressor to effect the seal between the screws or gears or the moving parts therein.

The flow-thru compressor 12 is powered by a turbine 18 which is driven by superheated vapor obtained by heat exchange with the heat of compression.

The effluent from the primary compressor 16 passes through conduit 20 into an oil gas separator 22, comprising a tank 24, and a vertical separating head 26. The sealant liquid is recycled through line 28.

The turbine is part of enclosed cycle 30, in which the expanded vapor is passed through line 32 into condensors 34. The condensed liquid is passed through line 36 by pump 38, through heat exchange with the effluent of the primary compressor 16 and returned by line 40 to the turbine, where the superheated vapor is expanded to drive the flow-thru compressor 12.

The closed cycle 30 comprises a boiler, which effects preheating and superheating of the medium in the cycle. The boiler may be located in any suitable relation to the effluent from the primary compressor 16. It also may be located in heat exchange with the effluent tube 20, as shown at 42; or may be located in the tank 24, as shown at 44; or it may be located in the liquid and gas effluents of the boiler 46, which is advantageously composed of two parts; namely , a preheater 48 and a superheater 50. The liquid effluent from the gas-oil separator passes through line 52 in heat exchange with the preheater 48, thence through return line 28 to the primary compressor 16. The preheated liquid vapor medium passes through line 54 into the superheater 50, where it passes in heat exchange with the separated gas effluent which passes out of the vertical separator 26 through line 56, and thence into exit line 58. The superheated vapor passes out of the superheater through line 40 to the turbine 18.

The primary compressor 16 is driven by any suitable prime mover 60 or 62, which is connected to the primary compressor 16 by any suitable transmission 64.

In operation of the device, air is drawn through intake 10 through the flow-thru compressor 12; then through line 14 into the primary compressor 16. Compressed air mixed with oil or other liquid sealant then passes through line 20 into the gas-oil separator 22. The separated hot gas passes out line 56 and 58, and the separated hot sealant liquid passes out through line 52 and is returned through 28 to the primary compressor 16.

The condensed liquid effluent of condensor 34 passes through pump 38, then through a boiler where superheated vapor is produced, which is passed through line 40 and expanded in turbine 18 to drive the flow-thru compressor 12.

If desired, the boiler may be located in heat exchange with the effluent of the primary compressor 16 before the gas liquid separation as shown at 42; or it may be located after the separation, as shown at 46; or it may be located at an intermediate stage, as shown at 44. If desired, the superheater 50 can be located in the vertical separator 26, or in any other suitable location where heat transfer between the preheated medium and the hot gas component of the compressor can be effected.

It will be understood that while the invention has been illustrated with particular reference to an oil-sealed compressor, it is to be understood that any type of compressor can be utilized as the primary compressor. It is important, however, that a flow-thru compressor be utilized in the first stage of compression. First, because flow-thru compressors are of a high speed type most suitable for use in connection with a turbine. Such compressors can be driven by a turbine by direct drive without the necessity of any reducing gearing. In the second place, in the start-up operation, it is necessary that the air supplied to the primary compressor 16 pass freely through the compressor 12, since in the starting up operation, heat will not have been generated sufficient to drive the turbine 18. When an equilibrium stage is reached, and the turbine 18 is operating at capacity, it will then provide compressed air through line 14 to the primary compressor 16 and effectively provide a two-stage compressing system in which the first stage is operated by the heat generated in the second stage.

If desired, the intake 14 to the primary compressor 16 may be provided with an auxillary intake 68 regualted by the throttling valve 66. Thus, in the start-up operation, the valve 66 can be opened to give direct flow of ambient air into the primary compressor 16 and gradually throttled down by valve 66, as the flow-thru compressor 12 becomes more and more effective. Also it may sometimes be desirable to leave the valve 66 partially open, even after the flow-thru compressor 12 has reached its maximum output.

Any suitable liquid can be utilized in the closed liquid-vapor cycle provided only that it has a boiling point sufficiently low that is can be vaporized and superheated by the heat generated in the primary compression. Freon R-114, for example, is suitable. Ordinarily, the mass or value of liquid-vapor medium, taking into account the latent heat of vaporization of the liquid, will be correlated with the quantity of heat available so as to obtain effective operation of the closed cycle.

It is to be understood that the invention is not to be limited to the exact details of operation or structure shown and described, as obvious modifications and equivalents will be apparent to one skilled in the art.

I claim:

1. An air compressor comprising;

(a) a primary compressor;

(b) a prime mover for driving said primary compressor;

(c) a high speed flow-thru compressor;

(d) a turbine for driving said flow-thru compressor;

(e) means for channeling the output of said flow-thru compressor into the intake of said primary compressor;

(f) heat exchange means for extracting heat of compression from the effluent of said primary compressor;

(g) a closed liquid vapor cycle including a condensor, a boiler, and said turbine;

(h) said boiler being thermally connected with said heat exchange means whereby the heat of compression is transferred to the liquid-vapor medium in said cycle, and the mass of said liquid, the boiling point thereof, and the latent heat of vaporization thereof being such that the heat of compression will convert said liquid into a super-heated vapor in a quantity and a pressure sufficient to drive said turbine.

2. A process for compressing air comprising the steps of: drawing ambient air through a high-speed, flow-through compressor driven by a turbine into a primary compressor driven by a prime mover independent of said turbine, generating superheated vapor for driving said turbine by means of the heat of compression of the primary compressor, and expanding said superheated vapor in said turbine to drive said flow-thru compressor.

3. An air compressing system comprising (a) a primary compressor;

(b) a prime mover for driving said primary compressor;

(c) a high speed flow-thru compressor;

(d) a turbine for driving said flow-thru compressor;

(e) means for channeling the output of said flow-thru compressor into the intake of said primary compressor;

(f) heat exchanger means for extracting heat of compression from the effluent of said primary compressor;

(g) a closed liquid vapor cycle including a condensor, a boiler, and said turbine;

(h) said boiler being thermally connected with said heat exchange means whereby the heat of compression is transferred to the liquid-vapor medium in said cycle, and the mass of said liquid, the boiling point thereof, and the latent heat of vaporization thereof being such that the heat of compression will convert said liquid into a super-heated vapor in a quantity and a pressure sufficient to drive said turbine; in which the primary compressor is one in which a sealant liquid is cycled through the compressor, cooled, separated from the compressed effluent, and returned to said primary compressor;

and in which the cooling of said sealant liquid is effected at least in part by heat exchange with condensed said liquid-vapor medium.

4. An air compressing system of claim 3 in which said boiler comprises a preheater and a superheater and in which said heat exchange means comprises means for effecting heat exchange in said preheater with hot sealant liquid and means for effecting heat exchange in said superheater with hot compressed gas.

* * * * *

UNITED STATES PATENT AND TRADEMARK OFFICE

CERTIFICATE OF CORRECTION

PATENT NO. : 4,307,574

DATED : December 29, 1981

INVENTOR(S) : Joseph A. Gamell

It is certified that error appears in the above—identified patent and that said Letters Patent is hereby corrected as shown below:

Col. 3, line 56; "auxillary" should read -- auxiliary --
Col. 3, line 56; "regualted" should read -- regulated --
Col. 4, line 52; "exchanger" should read -- exchange --

Signed and Sealed this

*Twenty-fifth* Day of *May 1982*

[SEAL]

*Attest:*

GERALD J. MOSSINGHOFF

*Attesting Officer*

*Commissioner of Patents and Trademarks*